United States Patent [19]

Montalto

[11] 4,019,733

[45] Apr. 26, 1977

[54] SHEET REGISTRATION MECHANISM

[75] Inventor: Michael Samuel Montalto, Rochester, N.Y.

[73] Assignee: Eastman Kodak Company, Rochester, N.Y.

[22] Filed: July 2, 1976

[21] Appl. No.: 702,313

[52] U.S. Cl. ..... 271/245; 271/242

[51] Int. Cl.[2] ..... B65H 9/06

[58] Field of Search ..... 271/245, 246, 243, 242, 271/235, 253, 254, 255, 236, 226, 227, 247

[56] References Cited

UNITED STATES PATENTS

| | | | |
|---|---|---|---|
| 3,015,485 | 1/1962 | Smith | 271/246 |
| 3,072,397 | 1/1963 | Kelchner | 271/245 |

*Primary Examiner*—Evon C. Blunk
*Assistant Examiner*—Bruce H. Stoner, Jr.
*Attorney, Agent, or Firm*—L. P . Kessler

[57] ABSTRACT

A registration mechanism for feeding sheets seriatim including a plurality of continuously driven roller sets located along a sheet feed path. A first roller set receives the sheets seriatim and moves the sheets toward a second roller set. The second roller set includes a pair of axially spaced, continuously driven rollers mounted on a drive shaft and a pair of thrust washers which sandwich a registration disc therebetween, the disc being freely mounted on the roller drive shaft. The registration disc has a registration finger which selectively extends through the sheet feed path. When the finger is positioned to extend through the feed path, it is latched to prevent rotation of the disc and provide registration of the sheets fed by the first roller set against the finger. At predetermined time intervals, the finger is unlatched and due to the action of the thrust washers on the disc, the disc is rotated with the driven rollers to move the finger out of the sheet feed path to enable the sheet to be fed by the rollers in registration to a downstream processing station.

4 Claims, 4 Drawing Figures

SHEET REGISTRATION MECHANISM

BACKGROUND OF THE INVENTION

1. Field of the Invention

This invention relates to sheet feeding apparatus and more particularly to a registration mechanism for an apparatus for sheets fed seriatim.

2. Description of the Prior Art

In certain types of high speed reproduction equipment such as printing presses and electrophotographic copying machines, it has been a general practice to make copies on individual sheets of material. This eliminates the time (and apparatus) needed to process a web into cut sheets of desired size. The individual sheets are fed from a hopper seriatim along a delivery path to a printing plate bearing an ink or toner image. Since the plate may be moving relative to the path of the cut sheets, the movement of the sheets must be coordinated with the movement of the plate to insure registration of a sheet with an image to be copied. A registration mechanism, provided in the delivery path, typically includes a member which intercepts the delivery path and is contacted by the individual sheets as they are fed seriatim from the hopper. The member, which may be, for example, a gate or a roller, will stop the sheets (or at least slow the movement thereof) for the purpose of alignment, and then at a proper time release the sheets to be fed to the printing plate in registration with the image thereon. To enable the reproduction equipment to operate a high speed, a continuously operating drive moves the sheets into contact with the registration mechanism at a speed greater than the timed speed of movement necessary for the sheet to have proper registration with the image to be copied. This may cause the sheets to buckle, which in turn effects the degree of accuracy of registration in that upon release by the registration mechanism, the sheets will have variable spring-out forces induced by the buckle.

SUMMARY OF THE INVENTION

It is the purpose of this invention to provide a mechanism for accurate, repeatable registration of sheets fed seriatim, the apparatus being of simple construction capable of high speed operation. The registration mechanism includes a plurality of continuously driven roller sets located along a sheet feed path. A first roller set receives the sheets seriatim and moves the sheets toward a second roller set. The second roller set includes a pair of axially spaced, continuously driven rollers mounted on a drive shaft and a pair of thrust washers which sandwich a registration disc therebetween, the disc being freely mounted on the roller drive shaft. The registration disc has a registration finger which selectively extends through the sheet feed path. When the finger is positioned to extend through the feed path, it is latched to prevent rotation of the disc and provide registration of the sheets fed by the first roller set against the finger. At predetermined timed intervals, the finger is unlatched and due to the action of the thrust washers on the disc, the disc is rotated with the driven rollers to move the finger out of the sheet feed path to enable the sheet to be fed by the rollers in registration to a downstream processing station.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
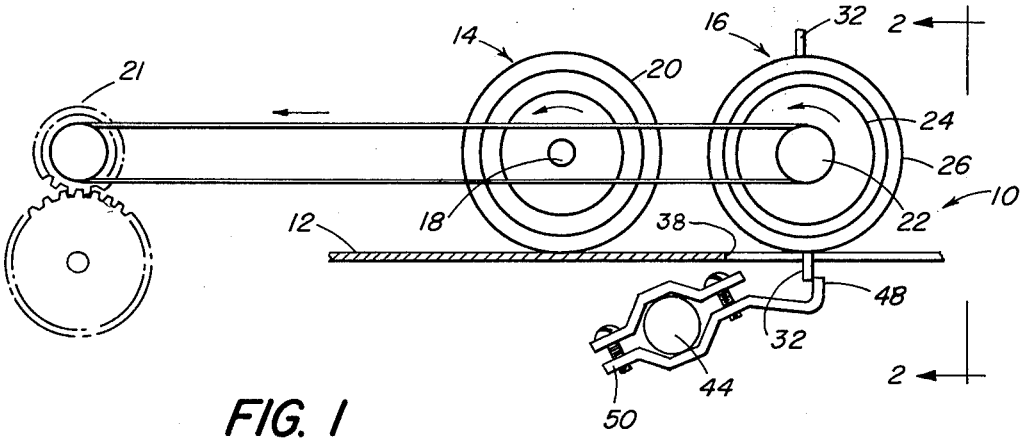
FIG. 1 is a side elevational view, partly in section, of the registration mechanism of this invention.
Figure 2:
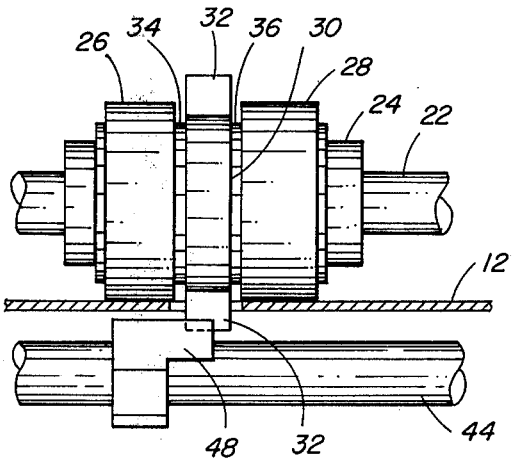
FIG. 2 is a front elevational view of a portion of the registration mechanism, partly in section, taken generally on the lines 2—2 of FIG. 1.

The registration mechanism 10 of this invention, as shown in FIGS. 1 and 2, serves as a timing device for feeding sheet seriatim in a predetermined time relationship, as for example in a copying apparatus from a supply hopper to a moving photoconductor bearing a toner image. The mechanism 10 includes a support 12 which receives sheets fed seriatim from an upstream supply (not shown) and defines at least a portion of a sheet travel path. An urging roller set 14 feeds the sheets along the support 12 to an integrated roller set 16. Although only one urging roller set 14 and one integrated roller set 16 are shown in the side elevational view of FIG. 1, at least two of each of the roller sets are generally provided across the sheet travel path.

The surface of the roller in the urging roller set 14 is preferably an open celled foam material 20 capable of developing the necessary friction force on a sheet to move the sheet without damage thereto along the portion of the sheet path defined by support 12. The roller set 14 which is of a preselected diameter, is mounted on a shaft 18 located above the support 12. The integrated roller set 16 is driven by a drive mechanism 21 drivingly connected with a shaft 22 supporting the roller set 16. The shafts 22 is located above the support 12 at the same general elevation as shaft 18. The shaft 18 is interconnected with the shaft 22 by any suitable means (such as a gear train, not shown) to rotate the urging roller set 14 in the same direction and at the same speed as the integrated roller set.

Figure 3:
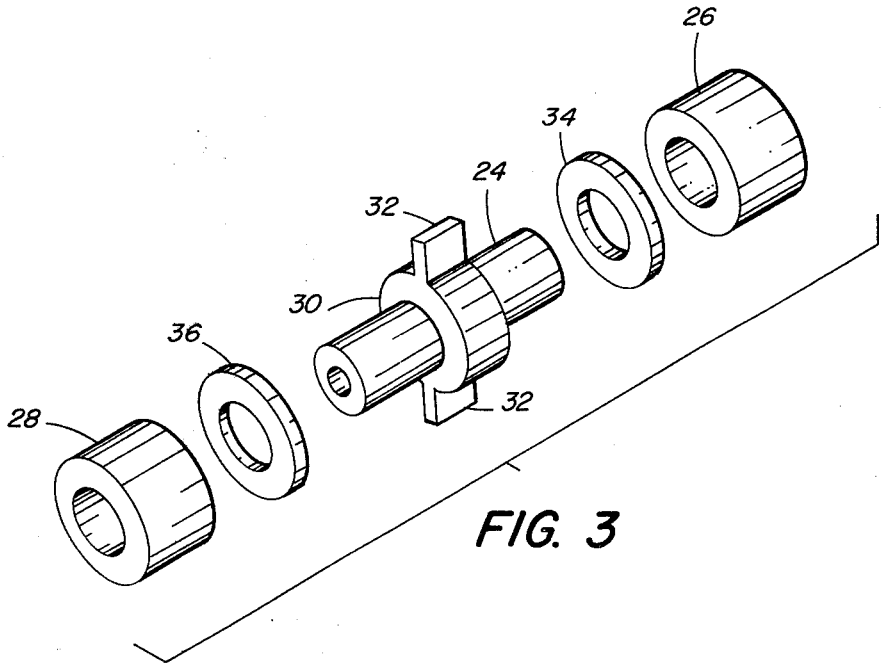
FIG. 3 is an exploded view of the integrated roller set of the registration mechanism of this invention.

The integrated roller set 16, which is shown in detail in the exploded view of FIG. 3, includes a hub 24 integrally mounted on the shaft 22. A pair of spaced apart rollers 26 and 28 are fixed to the hub 24 for rotation therewith. The rollers 26 and 28 are of foam material similar to that of the roller of the urging roller set 14 and are also of a preselected diameter such that they will develop the necessary friction forces to move a sheet along its travel path on support 12 without damaging the sheet. A registration disc 30, having a pair of registration fingers 32, is located between the rollers 26 and 28 is supported by the hub 24 but is free to rotate relative thereto. The registration fingers 32 of the disc 30 are substantially diametrically opposed. Thrust washers 34, 36 are located between the rollers 26 and 28 and the disc 30 so as to maintain an axial loading force on the disc from the rollers. The disc 30 is located above an opening 38 in the support 12 such that the fingers 32 may be positioned to intercept the sheet travel path in the manner to be described hereinbelow.

Figure 4:
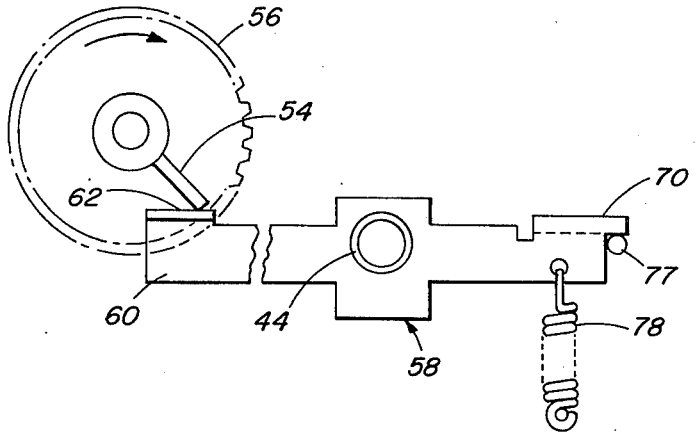
FIG. 4 is a side elevational view of the registration latch trip mechanism.

In order to selectively immobilize the disc 30 of the integrated roller set 16 with the fingers in their travel path blocking position, a latch 48 engageable with the fingers 32 is secured to the shaft 44 by a clamp 50. The latch 48 is controlled by a registration trip mechanism as substantially shown in FIG. 4 which periodically releases the latch by imparting oscillation to the shaft 44. The registration trip mechanism is actuated by a lobe 54 on gear 56 which is driven in synchronism with the approach of a toned image in the copy apparatus (not shown). The gear 56 is driven at a speed of one revolution per cycle of the copying apparatus, i.e., one revolution per image appearing on the photoconductor in a copy station. The trip mechanism includes a bracket 58 fixed to the shaft 44 for movement with the shaft. The bracket 58 has an integral lever 60 with an upper surface 62 on the forward end on the lever 60 extending into the path of and engageable by the lobe 54. Movement of the lever 60 (and thus the bracket 58) by the lobe 54 will thus be directly transmitted to the shaft 44 to oscillate the shaft and move the latch 48 out of the path of the finger. The trip mechanism is biased to its rest position against a stop 77 by a spring 78 connected to the portion 70 to normally position the latch 48 in the path of the fingers 32.

With the construction of the registration mechanism 10 thus described, the operation is as follows: The drive mechanism 21 is actuated to rotate the integrated roller set 16 which in turn drives the urging roller set 14. When the copying apparatus is activated, a sheet is fed from a supply onto the support 12 and urged by the roller set 14 against the registration finger 32 of the disc 30. The disc 30 (and thus the finger 32) is maintained in a sheet path blocking position by the latch 48 which prevents rotation of the disc by the roller 26 and 28 through the thrust washers 34 and 36. Since the roller sets 14 and 16 are constantly driven, the roller set 14 will urge the sheet against the finger 32 to register the sheet and remove any misalignment thereof. As noted above, the material 20 of the roller set 14 and its location above the support 12 will enable the roller to slip on a registered sheet rather than causing the sheet to buckle-up between roller sets 14 and 16. Each sheet will remain in its stopped location until the finger 32 is released, the release being timed by the rotation of the gear 56 interrelated to the arrival of a toner image at a downstream location. Release of the finger 32 by timed pivoting of the latch 48, will free the finger from constraints on its rotary motion.

Due to the axial loading of the thrust washers 34, 36 and the disc 30, when the finger 32 is released the disc 30 is rotated by frictional engagement with the rollers 26 and 28. This permits a sheet to be fed into the nip of the integrated roller set 16 and the support 12 so to be fed into contact with and in proper timed registration to a toned image in a downstream transfer or printing station (not shown). As soon as the lobe 54 passes the lever 60, the trip mechanism will be returned to its rest position against stop 77 by the spring 78. The latch 48 will thus be in position to engage the opposite finger 32 as it rotates around with the rollers 26 and 28. However, prior to such engagement the opposite finger will slip on the surface of the just fed sheet leaving the nip of integrated roller sets 16. When the finger engages the latch 48 the rotation of the disc 30 will again be arrested and will slip relative to the rollers 26 and 28. The finger will thus be in the sheet blocking position for the next sheet fed to the urging roller set 14 to register and align this subsequent sheet. The operation is repeated for each toned image arriving in the transfer station.

From the foregoing it is apparent that there is herein provided a registration mechanism of simple construction which repeatably registers and times the feeding of sheets seriatim to, for example, the transfer station of a copying apparatus. The mechanism urges each sheet against a latched finger which is selectively released from a sheet path blocking position at a predetermined time to permit the sheet to be fed in timed registration to a downstream location. The finger is dependent from a disc under axial loading by thrust washers from continuously rotating feed rollers. A trip mechanism actuates a latch release at timed intervals to enable the disc to be rotated out of the sheet path blocking position clearing the sheet path for registered feeding movement of the sheet.

The invention has been described in detail with particular reference to preferred embodiment thereof, but will be understood that variations and modifications can be effected within the spirit and scope of the invention.

I claim:

1. A sheet registration mechanism comprising: a support establishing a travel path for sheets; means for urging such sheets seriatim along said support in said travel path; means downstream of said urging means for registering and feeding such sheets at a precise point in a predetermined time cycle for sheet movement in said travel path, said registering and feeding means including a continuously rotating feed roller mounted on a drive shaft, a rotatable registration disc for selectively intercepting and at least momentarily stopping a sheet in said travel path upstream of said feed roller, and means for axially loading said registration disc into frictional driving engagement with said feed roller; means for selectively latching said registration disc to prevent rotation of said registration disc by said feed roller when said registration disc is in position to intercept a sheet; and means for unlatching said latching means to release said registration disc at said precise point in said time cycle whereby said registration disc may be rotated out of said sheet intercepting position enabling said feed roller to feed the intercepted sheet.

2. The invention of claim 1 wherein said registration disc is mounted on said drive shaft for rotation relative thereto, and includes at least one registration finger extending outwardly from said registration disc for engaging the leading edge of an intercepted sheet.

3. In an apparatus for feeding sheets seriatim, a registration mechanism for aligning such sheets and timing the feeding thereof in relation to a predetermining time cycle, said registration mechanism comprising:

a sheet support for establishing a path along which such sheets may travel;

an urging roller mounted relative to said support for moving such sheets seriatim along said support;

an integrated roller set located downstream of said urging roller, said integrated roller set including a continuously rotating shaft positioned adjacent said support, said shaft having a hub portion, a pair of spaced rollers secured to said hub for rotation therewith, a registration disc supported on said hub for rotation relative to said hub, said registration on disc having at least one registration finger, a pair of thrust washers located between said registration disc and said rollers for axially loading said registration disc into frictional driving engagement with said rollers to urge said disc to rotate with said rollers;

means for selectively latching said registration disc to inhibit rotation thereof, said registration finger being positioned to intercept said travel path when said disc is latched;

a trip mechanism for selectively releasing said selective latching means to free said disc for rotation with said rollers to move said registration finger out of said sheet travel path; and means for periodically actuating said trip mechanism at a precise point in said time cycle.

4. The invention of claim 3 wherein said means for selectively latching said registration disc includes a shaft positioned adjacent said support on the opposite side thereof from said shaft supporting said integrated roller set, said shaft being mounted for oscillation about its longitudinal axis, a latch member mounted on said shaft for oscillation therewith between a first position where said latch member engages said registration finger when said registration finger is in position to intercept said sheet travel path and a second position where said latch member is disengaged from said registration finger.

* * * * *